United States Patent [19]

Manz

[11] 4,271,979

[45] Jun. 9, 1981

[54] TOOTHPICK DISPENSING DEVICE

[76] Inventor: Curtis T. Manz, P.O. Box 2466, Long Beach, Calif. 90801

[21] Appl. No.: 55,541

[22] Filed: Jul. 9, 1979

Related U.S. Application Data

[63] Continuation-in-part of Ser. No. 922,768, Jul. 7, 1978, Pat. No. 4,197,965.

[51] Int. Cl.[3] ..... B65D 85/20

[52] U.S. Cl. ..... 221/288; 221/312 R; 206/443

[58] Field of Search ..... 221/186, 263, 266, 288, 221/312 R, 312 C; 206/443

[56] References Cited

U.S. PATENT DOCUMENTS

| | | | |
|---|---|---|---|
| 2,193,732 | 3/1940 | Luber | 221/312 R X |
| 2,448,099 | 8/1948 | Kassovic | 221/312 R |
| 4,197,965 | 4/1980 | Manz | 221/266 |

*Primary Examiner*—Joseph J. Rolla
*Attorney, Agent, or Firm*—William C. Babcock

[57] ABSTRACT

A device for transforming a toothpick container of the type that includes a cylindrical receptacle in which the toothpicks are marketed and that has external threads on the open end portion that are removably engaged by an internally threaded cap into a dispenser from which a single toothpick is ejected when the receptacle is disposed in a downwardly inclined position.

3 Claims, 8 Drawing Figures

FIG. 1
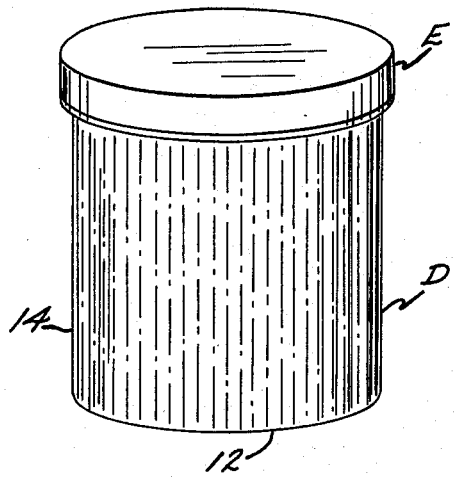
FIG. 2
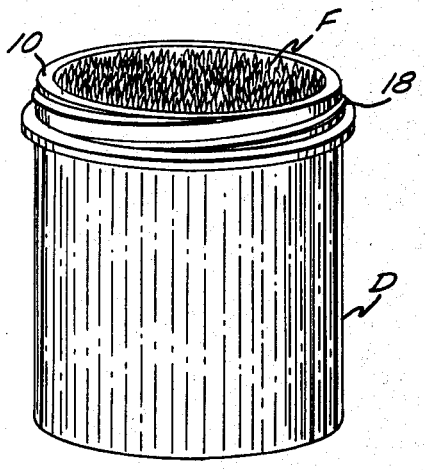
FIG. 3
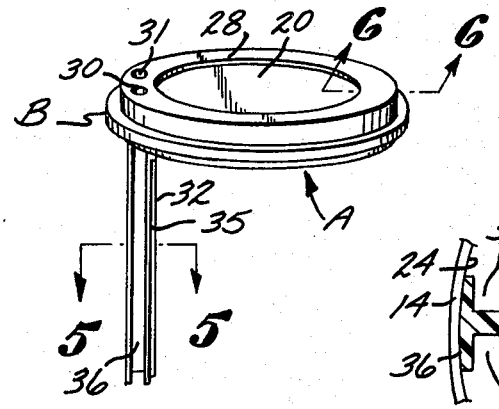
FIG. 4
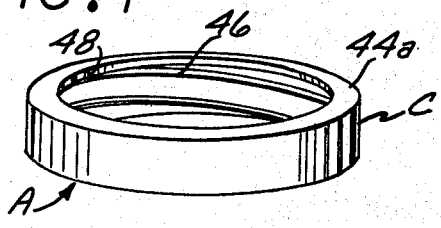
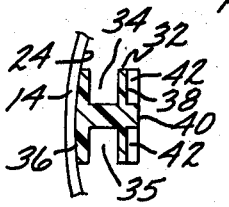
FIG. 5
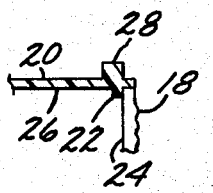
FIG. 6
FIG. 7
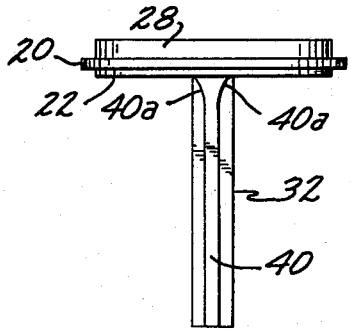
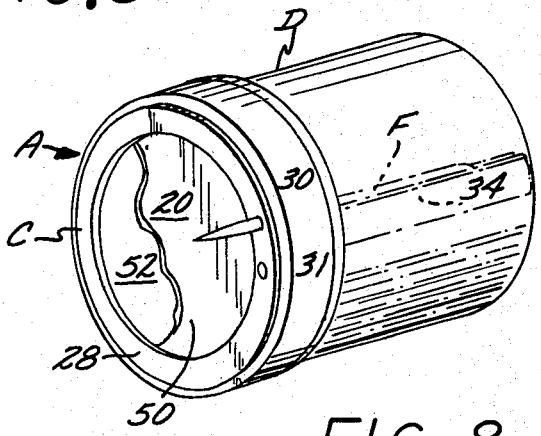
FIG. 8

TOOTHPICK DISPENSING DEVICE

CROSS-REFERENCE TO RELATED APPLICATION

The present application is a continuation-in-part of my co-pending application Ser. No. 922,768 entitled, "Toothpick Dispenser" that was filed July 7, 1978, and that issued as U.S. Pat. No. 4,197,965 on Apr. 15, 1980.

BACKGROUND OF THE INVENTION

1. Field of the Invention

Toothpick Dispensing Device.

2. Description of the Prior Art

In the past, numerous toothpick dispensers have been described and used, but such dispensers have the operational disadvantage that they required a receptacle of special design in which the toothpicks are stored prior to being dispensed.

A major object of the present invention is to provide an assembly that replaces the screw cap on a cylindrical container in which toothpicks are marked, and the assembly after replacing the cap permitting the toothpicks to be sequentially dispensed one-by-one from the container each time the container is manually disposed in a downwardly inclined position.

SUMMARY OF THE INVENTION

Toothpicks are currently retailed in a cylindrical receptacle that has an externally threaded open end that is normally closed by an internally threaded screw-on type cap. The cap must be removed from the receptacle each time a tooth pick is to be removed therefrom. The present invention replaces the cap, and permits the toothpicks to be sequentially dispensed one-by-one each time the receptacle is placed in an inclined position.

The present invention includes a circular plate that abuts against the open end of the receptacle after the cap is removed therefrom. The plate has two circumferentially spaced first and second openings therein, through either of which single toothpicks may be dispensed. An elongate rigid member projects outwardly from a first side of the plate adjacent the outer periphery thereof, with the member having first and second oppositely disposed longitudinal grooves therein that are in communication with the first and second openings. An internally threaded ring having an inwardly extending circular lip serves to removably support the plate on the open end portion of the receptacle.

When the present invention is mounted on a receptacle, and the receptacle is moved to a downwardly inclined position, one of the toothpicks will become engaged in either the first or second groove, depending on which groove is upwardly disposed, and by gravity will slide along the groove and be ejected from the opening in the plate operatively associated with that groove.

BRIEF DESCRIPTION OF THE DRAWING

FIG. 1 is a perspective view of a present-day package of toothpicks that includes a cylindrical receptacle that is closed by a screw-on type cap;

FIG. 2 is the same view as shown in FIG. 1 after the cap has been removed from the receptacle;

FIG. 3 is a perspective view of a first portion of the toothpick dispenser that replaces the cap on the receptacle;

FIG. 4 is a perspective view of a second portion of the assembly;

FIG. 5 is a transverse cross-sectional view of the toothpick dispensing member taken on the line 5—5 of FIG. 3 and showing how one side thereof is in abutting contact with the interior surface of the receptacle;

FIG. 6 is a fragmentary transverse cross-sectional view of the first portion of the toothpick dispenser and illustrating how it removably engages the upper open end of the toothpick holding receptacle;

FIG. 7 is a side elevational view of the first portion of the toothpick dispenser; and FIG. 8 is a perspective view of the toothpick containing receptacle with the toothpick dispensing invention mounted thereon, and a portion of a dispensed toothpick projecting therefrom.

DESCRIPTION OF THE PREFERRED EMBODIMENT

The invention A as best seen in FIGS. 3 and 4 includes a first portion B and second portion C. The invention is used in combination with a conventional cylindrical receptacle D of a type that is currently used in marketing toothpicks F, with the receptacle being normally closed by a screw-on type cover E.

The receptacle D includes a circular bottom 12 from which a cylindrical side wall 14 extends upwardly to terminate in the open end 10, and the side wall adjacent the open end 10 having external threads 18 defined thereon.

The first portion B of the invention includes a circular plate 20 having an external diameter that is substantially the same as the external diameter of the side wall 14. The plate 20 has a circular lip 22 projecting downwardly from the bottom thereof as best seen in FIG. 6 which lip has an external diameter substantially the same but slightly smaller than the interior diameter of the side wall 14. The circular plate 20 has a bottom surface 26.

A circular rib 28 extends upwardly from the top surface of the plate 20 as may be seen in FIG. 6 with the rib having first and second circumferentially spaced toothpick discharge openings 30 and 31 formed therein. An elongate toothpick receiving member 32 projects outwardly from the bottom 26 of plate 20, with the member tapering slightly longitudinally away from the bottom 26. The toothpick receiving member 32 has first and second toothpick receiving grooves 34 and 35 that extend longitudinally on opposite end surfaces thereof. The toothpick receiving member 32 also has a first transverse convex side surface 36 that is adapted to abut against the interior surface of the cylindrical side wall 14 when the invention A is mounted on the receptacle D as illustrated in FIG. 8. The toothpick receiving member 32 also includes a second side surface 38 that has a longitudinally extending centered protuberance 40 projecting outwardly therefrom, with the side surface and protuberance defining two longitudinally extending recesses 42. The protuberance 40 adjacent the plate 20 develops into two outwardly and opposite tapering end portion 48.

The second portion C of the invention includes a cylindrical ring 44 that has threads 46 defined on the exterior thereof, which threads are adapted to engage the threads 18 on the receptacle D, and the ring 44 including an upper portion 44*a* from which a circular lip 48 extends inwardly. The invention A is used by first removing the screw-type cover E from the receptacle D to expose the toothpicks F as shown in FIG. 2. The first portion B of the invention is then mounted on the receptacle D, for the bottom 26 of the plate 20 to rest on the upper open end 10 of the receptacle, with the elongate member 32 extending downwardly into the receptacle, with the side surface 36 thereof in abutting contact with the interior surface 24 of the side wall 14 of the receptacle D as shown in FIG. 5. The second portion C is then mounted to overlie the first portion B of the invention as shown in FIG. 8, with this being achieved by the threads 46 of the ring 44 being caused to engage the threads 18 on the receptacle. The circular lip 48 of the second form of the invention overlies the peripheral extremity of the plate 20 but not to the extent that it obstructs the first and second toothpick discharge openings 30 and 31 defined in the rib 38 that extends outwardly from the plate. The invention A when mounted on the receptacle D is shown in FIG. 8.

When the invention A is mounted on the receptacle D as shown in FIG. 8 and as previously described, a toothpick F may be dispensed from the receptacle by inclining the same with the first and second portions B and C in the most downwardly position. A toothpick F will enter the one of the first and second grooves 34 and 35 that is upwardly disposed, and will slide by gravity down the groove and through the opening 30 or 31 associated therewith to be dispensed from the receptacle. In FIG. 8 a toothpick F is shown being dispensed from the first groove 34 and the opening 30 associated therewith. Toothpicks adjacent the second side wall 38 will tend to move into the recesses 42, but will not tend to move longitudinally therein beyond the tapered portion 40*a* best seen in FIG. 7.

The top of the plate 20 and rib 28 define a circular recess 50 as shown in FIG. 8 in which a circular sheet 52 of paper may be inserted that bears suitable printed material such as a trademark or directions for using the invention (not shown).

The use and operation of the invention has been previously been described in detail and need not be repeated.

What is claimed is:

1. In combination with a receptacle having a cylindrical side wall that has external threads adjacent the open end thereof and that contains a plurality of toothpicks, an assembly to permit said toothpicks to be discharged from said container one by one each time said receptacle is inverted with said assembly in a downward position, said assembly including:

a. a first portion that includes a circular plate that has a circular lip extending downwardly therefrom, said lip extending downwardly in said open end and slidably engaging the interior surface of said side wall, an elongate tooth pick receiving member that extends downwardly from said circular plate, said member having a first side surface of transverse convex shape that abuts against the interior surface of said receptacle, said member having first and second end surfaces in which first and second longitudinal grooves are defined that are in communication with first and second openings formed in said plate; and b. a second portion that includes an internally threaded ring that removably engages said external threads, said ring including a circular lip that projects inwardly therefrom and engages a peripheral portion of said plate outwardly from said first and second openings, and one of said toothpicks in said receptacle being disposed in either said first or second grooves depending upon which one is uppermost when said receptacle is moved from a vertical to a downwardly inclined position, and said toothpick sliding by gravity through said opening in said plate that is operatively associated with said groove in which said toothpick is disposed, and one of said toothpicks being so dispensed each time the above-described operation is repeated.

2. As assembly as defined in claim 1 in which said first portion and second portion are each formed as an integral unit from a polymerized resin.

3. An assembly as defined in claim 1 which in addition includes a circular rib that projects upwardly from said plate and through which said first and second openings extend, said rib and plate cooperating to define a circular recess in which a sheet of material may be disposed that has suitable printed and decorative matter thereon.

* * * * *